US006430871B1

(12) United States Patent
Hebda

(10) Patent No.: US 6,430,871 B1
(45) Date of Patent: Aug. 13, 2002

(54) CONTROLLED DOOR OPERATOR

(76) Inventor: Thomas J. Hebda, 539 S. Park Rd., Lombard, IL (US) 60148

( * ) Notice: Subject to any disclaimer, the term of this patent is extended or adjusted under 35 U.S.C. 154(b) by 0 days.

(21) Appl. No.: 09/318,066

(22) Filed: May 24, 1999

(51) Int. Cl.[7] ..... E05F 15/10
(52) U.S. Cl. ..... 49/340; 49/139
(58) Field of Search ..... 49/139, 358, 359, 49/340, 341, 342, 345, 25, 26, 28

(56) References Cited

U.S. PATENT DOCUMENTS

| | | | | | |
|---|---|---|---|---|---|
| 618,053 | A | | 1/1899 | Brown | |
| 2,843,376 | A | | 7/1958 | Osuch | |
| 2,924,449 | A | | 2/1960 | Leimer | |
| 3,284,950 | A | | 11/1966 | Gute | |
| 3,886,425 | A | | 5/1975 | Weiss | |
| 4,330,958 | A | * | 5/1982 | Richmond | 49/340 |
| 4,348,835 | A | | 9/1982 | Jones | |
| 4,429,490 | A | | 2/1984 | Zunkel | |
| 4,658,545 | A | | 4/1987 | Ingham | |
| 4,669,218 | A | | 6/1987 | Kornbrekke | |
| 4,972,629 | A | | 11/1990 | Merendino | |
| 5,040,331 | A | | 8/1991 | Merendino | |
| 5,634,296 | A | * | 6/1997 | Hebda | 49/343 |
| 5,752,344 | A | * | 5/1998 | Richmond | 49/340 |
| 5,878,530 | A | * | 3/1999 | Eccleston et al. | 49/340 |
| 5,930,954 | A | * | 8/1999 | Hebda | 49/345 |
| 6,006,475 | A | * | 12/1999 | Schwantes et al. | 49/341 |

* cited by examiner

*Primary Examiner*—Curtis A Cohen
(74) *Attorney, Agent, or Firm*—Robert L. Marsh

(57) ABSTRACT

A door controlling device for opening and closing a door in a wall having a linkage connecting between the door and a wall and an arm pivotable about a pin. A drive member on the pin has a stand by position which does not interfere with the manual movement of the door. Rotation of the drive member in one direction rotates the arm around the pin to move the door to the open position and rotation of the drive member in the opposite direction rotates the arm around the pin to move the door to the closed position.

14 Claims, 5 Drawing Sheets

CONTROLLED DOOR OPERATOR

The present invention relates to a moter driven mechanism for opening and closing a door, in particular, to a mechanism wich can be operated remotely from the door.

BACKGROUND OF THE INVENTION

Several devices are available which use an electric motor to control the opening and closing of a door to a room. Devices are also available for which the opening or closing cycle can be initiated from a remote location using an infrared transmitter and the like such as disclosed in U.S. Pat. No. 5,040,331. Such door controlling devices must be constructed so that they do not suffer damage when the door is manually opened or closed. Similarly, they must be constructed so they do not to suffer damage when an object such as a chair blocks movement of the door during an opening or closing cycle.

Currently available door controlling devices utilize a slip clutch or the like which create a drag or resistance when the door is manually opened or closed. Such slip clutches do not terminate the door opening or closing cycle when the movement of the door is interrupted by contact with an item such as a chair or a person's hand and, as a result, such devices apply a force against the obstruction until the operating cycle is completed. It is, therefore, desirable to provide a door controlling device which can be operated remotely to open and close a door, which will not create resistance when the door is not manually opened or closed, and for which the opening or closing cycle will terminate when the door encounters an obstruction which prevents completion of the opening or closing cycle.

SUMMARY OF THE INVENTION

The present invention is embodied in a door controlling device for opening and closing a door in a wall. The device has a linkage having a first arm, one end of which is pivotally mounted by a pin to a bracket attached to the wall and the other end of which is pivotally attached to the second end of a second arm. The first end of the second arm is pivotally attached by a second pin to a second bracket mounted to the top of a door. The drive system for the device rotates one of the arms about the pin which joins the arm to its associated bracket to open or close the door.

The device includes a drive member which is connected by a gear train to a motor and which rotates about the pivot pin in one of the brackets. As the drive member turns around the pin it will engage the associated arm and force the arm to rotate through an open cycle or a close cycle. When the devise is not in use the drive member is in a stand-by position where it will not interfere with the movement of the arm while the door is being opened or closed. When the device is called upon to carry out a door open cycle, the motor and gear train rotate the drive member in one direction about the pivot pin and push the arm attached thereto to open the door. After the door has reached the fully open position, the motor will reverse direction and return the drive member to the stand-by position. When the devise is called upon to carry out a door close cycle, the motor and drive train will rotate the drive member in the opposite direction from the door open cycle, and after the door has reached the fully closed position, the motor will again reverse direction and return the drive member to the stand-by position.

The invention also includes a start means such as a switch or an infrared transmitter and receiver for starting an open cycle or a close cycle, a current measuring device for determining whether the motor is drawing an excessive amount of electric current, a door open detector for generating a signal when the door is in a fully opened position, a door closed detector for generating a signal when the door is in a fully closed position, and a stand-by detector for detecting when the drive member has returned to the stand-by condition. A control means, which is typically a computer, responds to the start means, the current measuring means, the door open detector, and the door closed detector, and the stand-by detector for directing current to the electric motor upon receipt of a signal from the start means, for reversing power to the motor to thereby reverse the direction of the motor upon receipt of a signal from the current measuring means, the door open detector or the door closed detector, and for terminating power to the motor on receipt of a signal from the stand-by detector.

The devise is entirely disengaged when the drive member is in the standby condition. When the device is carrying out a door open or a door close cycle, and the moving door contacts a foreign object such as a chair or a person's hand, the current measuring means will detect an increase in the current drawn by the electric motor in response to the resistance caused by the foreign object, and the control means will reverse the power to the electric motor and return the drive member to the stand-by position.

GENERAL DESCRIPTION OF THE DRAWINGS

A better understanding of the present invention can be had after a reading of the following detailed description taken in conjunction with the drawings in which.

DETAILED DESCRIPTION OF THE PREFERRED EMBODIMENT

Figures 1, 2:
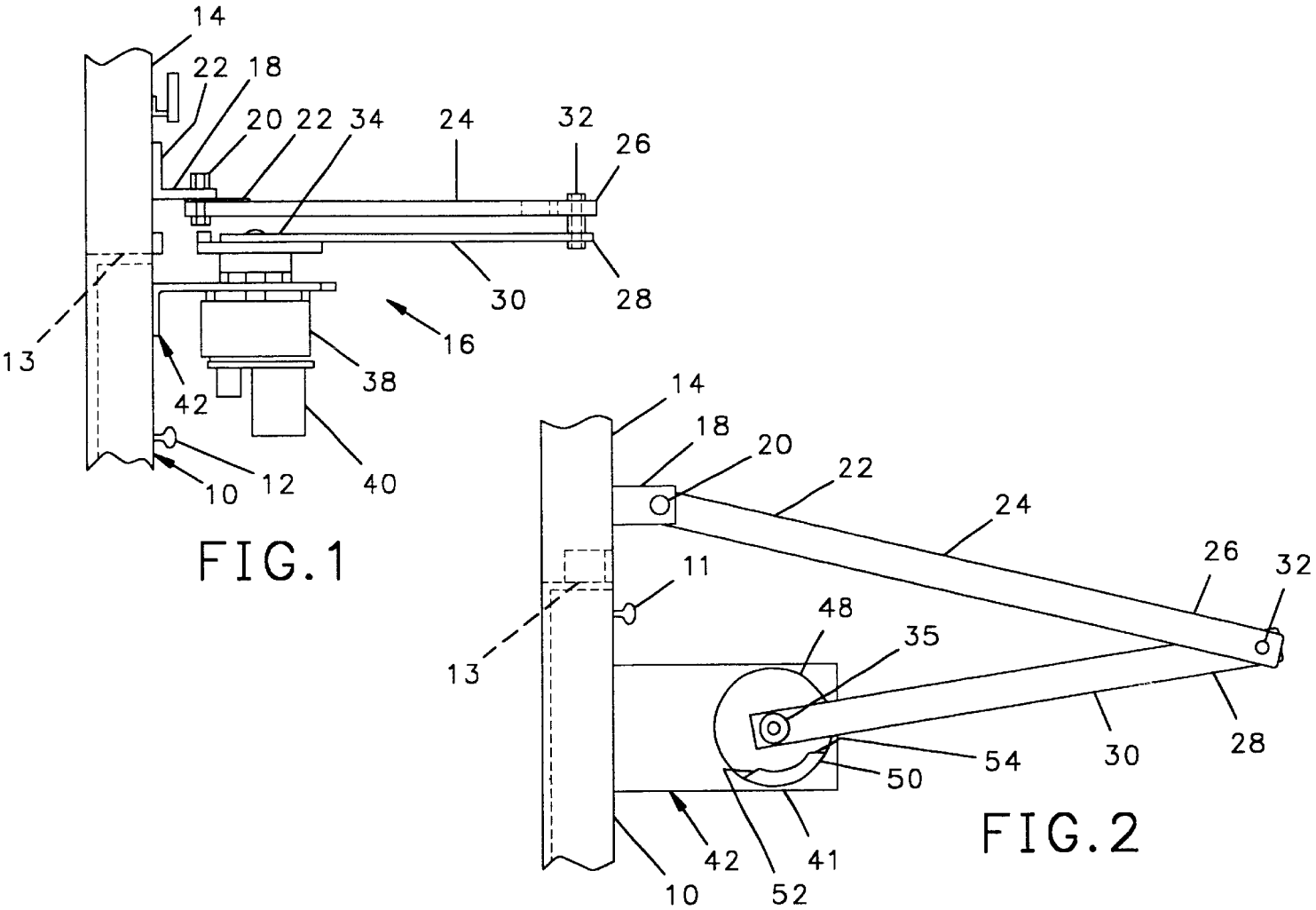
FIG. 1 is a side elevational view of a door operating device in accordance with the present invention attached to a door which is in the closed position with portions thereof shown in phantom lines.
FIG. 2 is a top elevational view of the door operating device shown in FIG. 1 with the door in the closed position.

Referring to FIGS. 1, 2, 3, and 4, a door 10 having a door knob 11 is pivotally mounted about a horizontal axis on a plurality of pins, one of which 12, is shown such that the door 10 opens and closes against a frame defining an opening 13 in a wall 14. A door operating device 16 in accordance with the present invention has a first bracket 18 mounted above the door 10 and pivotally attached to the bracket 18 by a pin 20 is the first end 22 of an elongate first arm 24. The second end 26 of the first arm 24 is pivotally attached to the second end 28 of a second arm 30 by a second pin 32. The first end 34 of the second arm 30 is mounted on the distal end of a drive shaft 35 extending from a gear box 38 which is connected to a motor 40. The gear box 38 and the motor 40 assembly are rigidly mounted on a horizontal portion 41 of a second bracket 42 which in turn is attached by screws or the like, not shown, to the top of the door 10.

Figure 5:
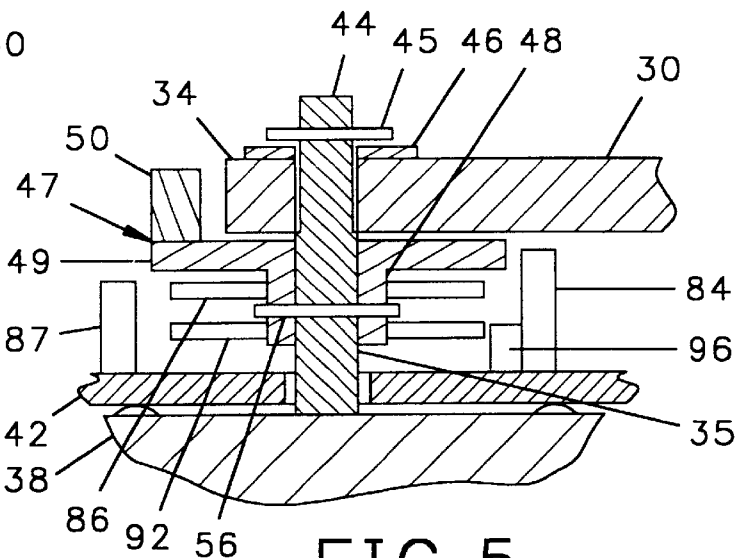
FIG. 5 is a further enlarged fragmentary cross sectional view of the device shown in FIG. 1.

Referring to FIG. 5, the distal end 44 of the drive shaft 35 has a reduced diameter which extends through a hole in the horizontal portion 41 of the bracket 42 and through an aperture in the second arm 30. The second arm 30 is pivotally retained to the distal end 44 of the shaft 35 by any suitable means such as a cotter pin 45 and washer 46 as shown.

Figure 6:
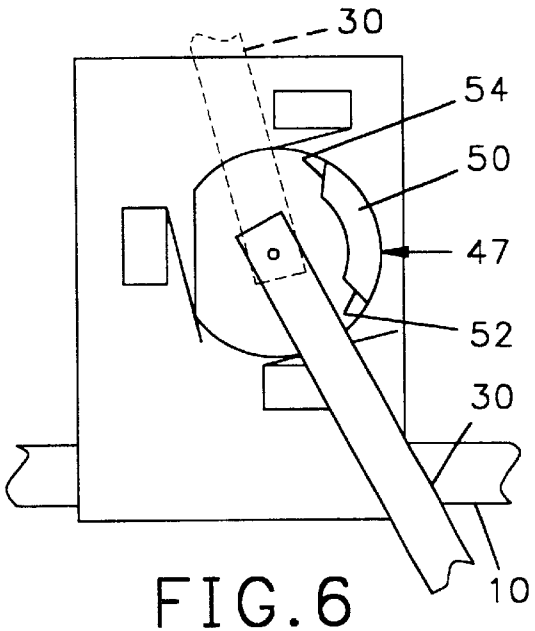
FIG. 6 is an enlarged fragmentary top view of the device as shown in FIG. 1 with the driven arm shown in solid lines in the door open position and shown in broken lines in the door closed position, and the driving member in the stand-by position.

Referring to FIGS. 5 and 6, fitted on the drive shaft 35 below the second arm 30 is drive member 47 having a lower tubular mounting portion 48 and a radially extending annular flange portion 49. Fixed to the upper surface of the annular flange portion 49 near the outer edge thereof is an arcuate drive pin 50 having a first driving surface 52 and a second driving surface 54. The tubular mounting portion 48 has diametrically opposing radial holes therein, which are aligned with a transverse hole in the drive shaft 35 and the mounting portion 48 is rotatably locked thereto by a pin 56 extending through the holes.

The motor 40 is reversible such that rotation of the motor 40 in one direction will cause the drive shaft 35 and the drive member 47 to rotate in one direction and rotation of the motor 40 in the opposite direction will cause drive shaft 35 and the drive member 47 to rotate in the opposite direction.

Referring to FIG. 6, when the devise is not in operation, the motor 40 and drive member 47 revert to a stand-by condition in which the drive pin 50 is in the stand-by position as shown. Energizing the motor 40 for rotation in the first direction will cause the shaft 35 and drive member 47 to rotate clockwise until the first drive surface 52 of the drive pin 50 engages a first side of the second arm 30, after which the arm 30 and the shaft 35 will rotate together to the door close position shown in broken lines. On the other hand, energizing the motor 40 for rotation in the opposite second direction will cause drive member 47 to turn in the counter clockwise direction. Rotation of the drive member 47 will then cause the second drive surface 54 to engage the opposite side of the second arm 30 and rotate the arm 30 about the shaft 35 to the door open position shown in solid lines. Rotation of the second arm 30 about the shaft 35 in one direction will cause the door to move from a closed position shown in FIG. 2 to an open position shown in FIG. 3, and rotation of the arm 30 in the opposite direction about shaft 35 will cause the door to move from an open position shown in FIG. 3 to a closed position shown in FIG. 2.

Figure 3:
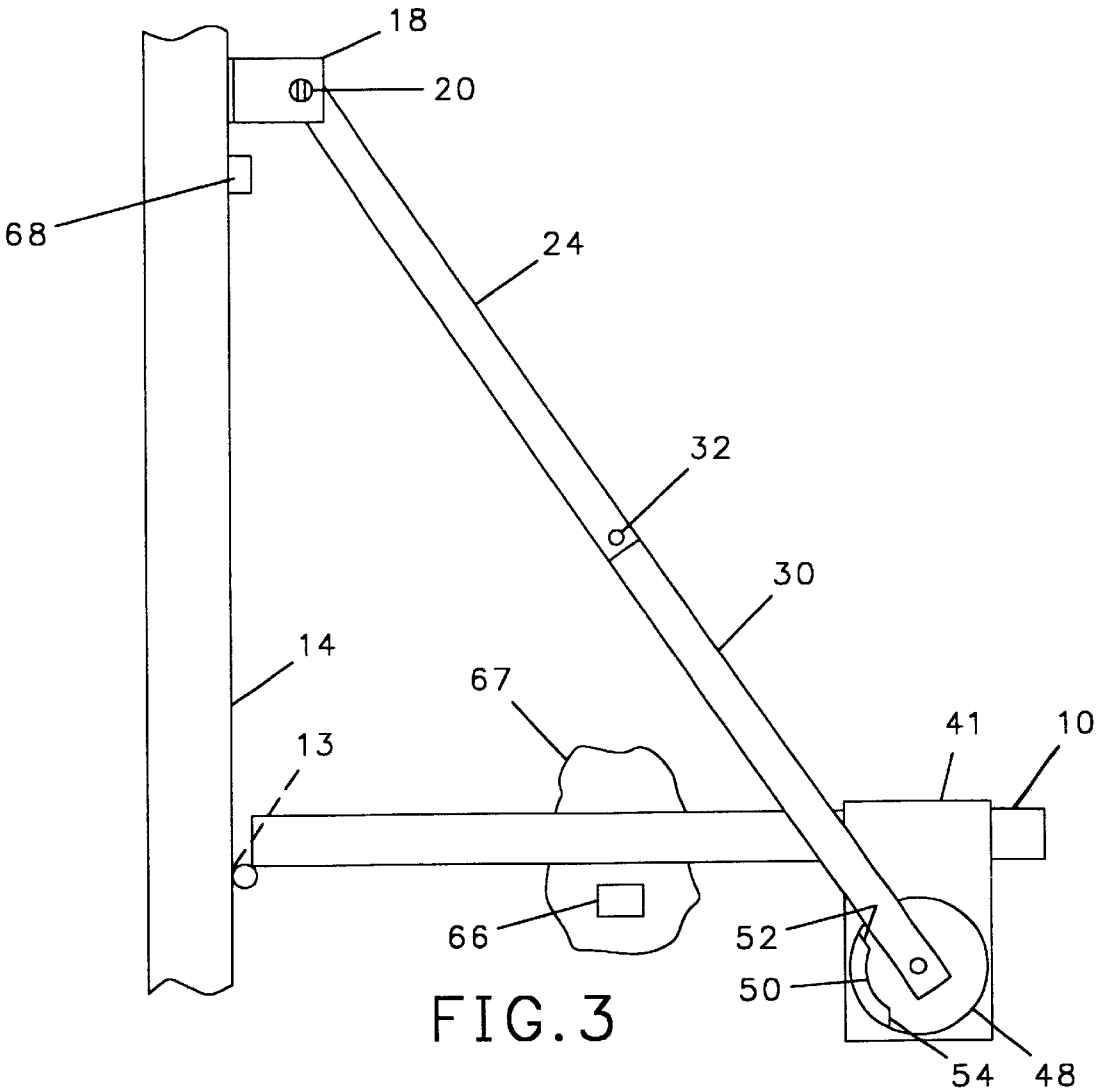
FIG. 3 is a top elevational view of the door operating device shown in FIG. 1 with the door in the open operating position.
Figure 4:
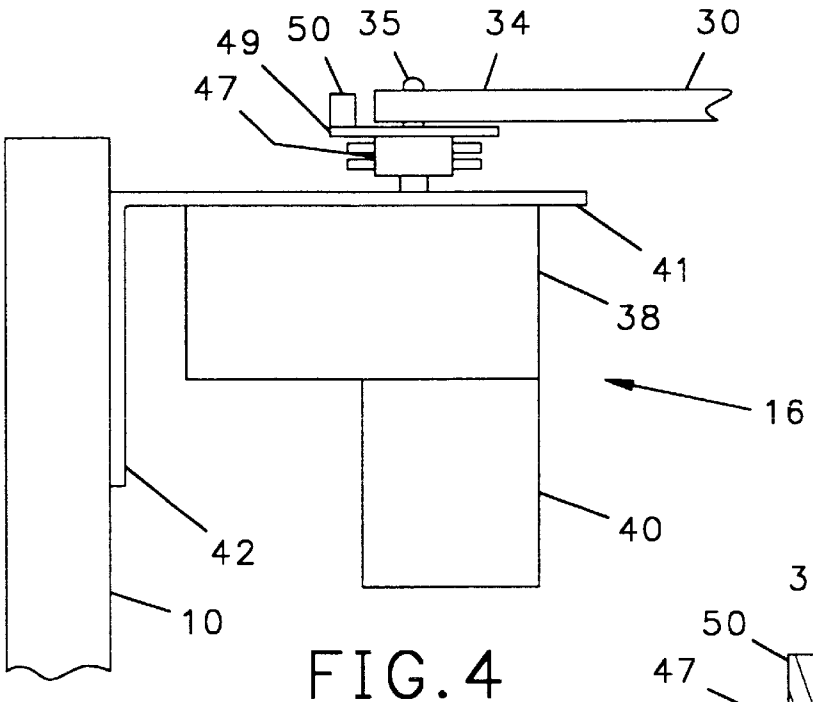
FIG. 4 is an enlarged fragmentary side elevational view of the door opening device shown in FIG. 1.
Figure 7:
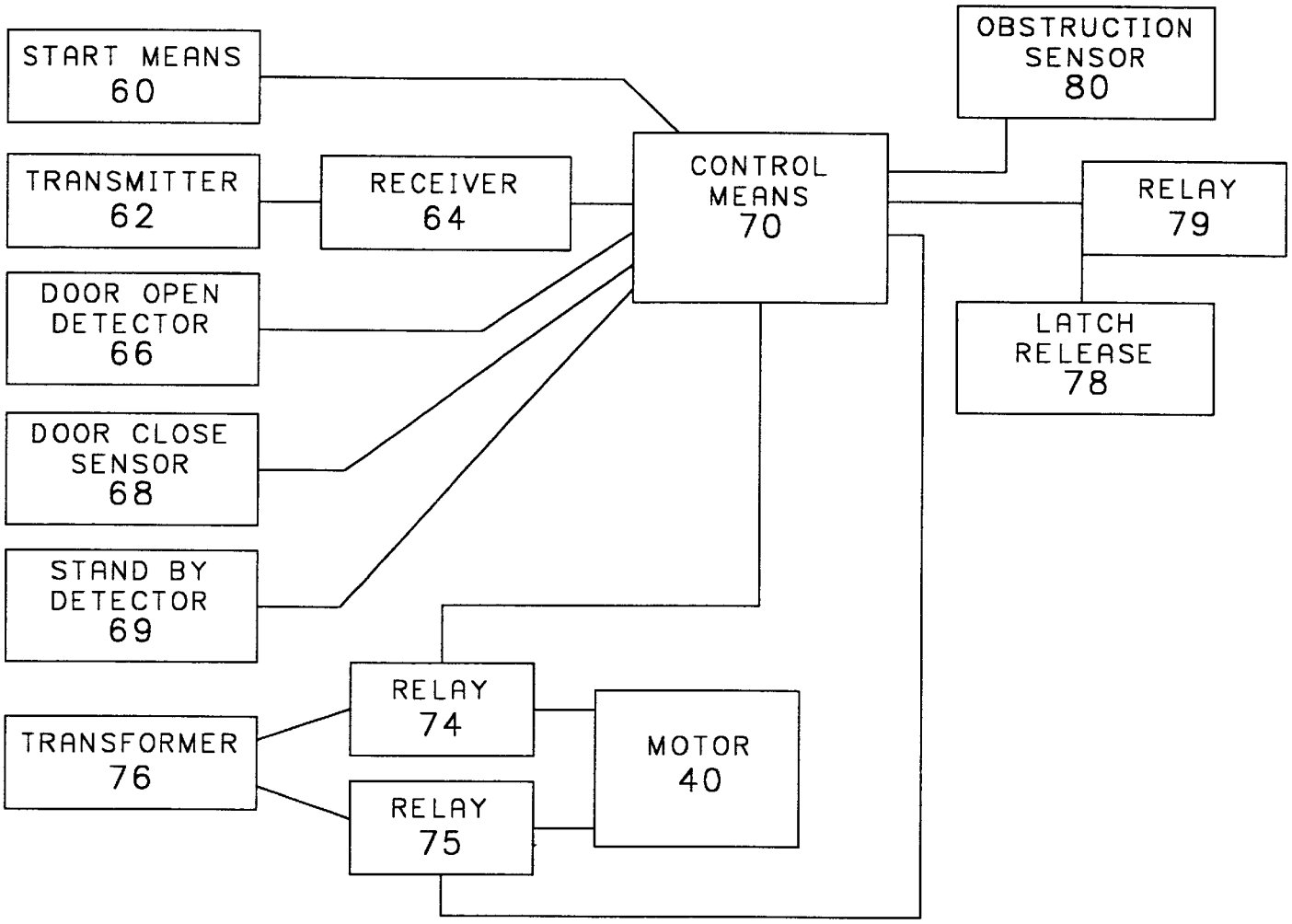
FIG. 7 is a block diagram of the device shown in FIG. 1.

Referring to FIG. 7, to initiate a door opening or closing cycle, the invention includes a start means which may be a simple button operated switch 60 located near the door 10 or on a desk remote from the door. The start means can also include an infrared hand-held transmitter 62 and a receiver 64 attached to the wall 14 above the door 10 as shown in FIG. 1. The device 16 also includes a door open detector 66 and a door close detector 68 for determining when the door has reached the fully open or fully closed condition, respectively. The door open detector and door closed detector may be simple switches positioned on the floor 67 or walls as shown in FIG. 3, so as to be actuated when the door reaches a fully open or fully closed condition or they may sense the angle of orientation of the first and second arms 24, 30, respectively, as further described below. A stand-by detector 69, which may be a simple limit switch as is further discussed below, is actuated when drive member 47 and the drive pin 50 are returned to the stand-by condition after the device 16 has been operated.

The circuit of the invention also includes a control means 70, which may be a computer chip, and the control means 70 operates a relay or transistorized switches 74 and 75, to connect or disconnect the electric motor 40 to a source of power for rotation in the first direction or the second direction respectively. The source of power may include a transformer 76 and a rectifier, not shown, for providing DC current suitable for a reversible electric motor 40.

As shown in FIGS. 2 and 7, the circuit might also include a latch release 78 in the frame 13 of the door and an associated relay 79 for releasing the latch of the door at the commencement of the door opening cycle. Such electrically operated latch releases are commonly known in the art and are used to unlock the outer doors of apartment buildings by an occupant of an apartment in the build who seeks to admit a visitor. The latch release 78 is energized by the computer 70 at the beginning of a cycle to permit movement of the door 10 without turning the door knob 11 to open the associated latch.

The circuit further includes an obstruction sensing means 80 for sensing when an obstruction is preventing the motor 40 from opening or closing the door after a door closing or opening cycle has been commenced. In the preferred embodiment, the obstruction sensing means 80 is an ammeter and a comparator circuit of the type commonly known in the art which can be adjusted such that when the current drawn by the motor 40 exceeds the current normally required to move the door 10 through a cycle it will signal the computer 70 and the computer will reverse the direction of the motor 40.

According to the invention, when the device is not in use the drive shaft 35 and the drive member 47 are in the stand-by position shown in FIG. 6. When the drive member is in the stand-by position, the drive pin 50 will not obstruct the rotation of the second arm 30 about the shaft 35 during the normal opening and closing of the door 10, and the door 10 may be opened or closed without resistance from the device 16.

To operate the device 16 the start means 60 is actuated to commence either a door open cycle or a door close cycle. If the door open cycle is actuated, switch 74 is closed and the motor 40 rotates in one direction, and if the door close cycle is actuated switch 75 is closed and the motor 40 operates in the opposite direction. As the motor 40 rotates, the shaft 35 and the drive member 47 are turned causing one of the drive surfaces 52, 54 of the drive pin 50 to engage the second arm 30 and rotate the arm 30 to thereby open or close the door 10.

When the door 10 reaches the fully open condition the door open detector 66 is actuated and when the door 10 reaches the fully closed condition the door closed detector 68 is actuated. On the actuation of either the door open detector 66 or the door closed detector 68, the computer 70 will reverse the polarity of the power to the motor 40 and thereby cause the motor 40 to operate in the opposite direction. Reversing the direction of the motor 40 will cause the drive pin 50 to break contact with the second arm 30 and the door 10 will remain opened or remain closed while the drive pin 50 returns to the stand-by condition as shown in FIG. 6. When the drive member 47 and the pin 50 reaches to the stand-by position, the stand-by detector 69 will be actuated and the computer 70 will terminate power to the motor 40, and the device 16 will again be in the stand-by condition.

The device 16 will not interfere with the movement of the door until the start means, such as a switch 60 or the hand-held transmitter 62 is again actuated. If the movement of the door is obstructed during the operation of the device because a chair or a person is standing in the door's path, the obstruction sensing means 80 will detect the presence of the obstruction and the computer 70 will reverse the polarity of power to the motor 40 and the drive pin 50 will return to the stand-by condition as described above.

Figure 8:
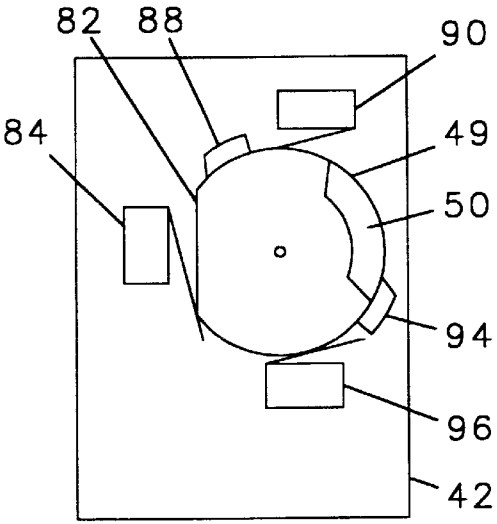
FIG. 8 is a top view of the drive member with the second arm removed.

Referring to FIGS. 5 and 8, in the preferred embodiment, the flange 49 of the drive member 47 is a cam having a flat 82. The flat 82 is engaged by a limit switch 84 when the drive member 47 is rotated to the stand-by position, such that the flat 82 and limit switch 84 form the stand-by detector 69.

In the preferred embodiment, the door open sensor and the door closed sensor are not mounted on the floor and walls as are sensors 66 and 68 shown in FIG. 3. Instead, when the angle of the arm 30 with respect to the mounting bracket 42 become oriented consistent with the door being in the closed condition, a door closed cam 86 mounted on the tubular portion 48 of the drive member 47, has a protrusion 88 which engages a second limit switch 90 to signal the control means 70 to reverse power to the motor. Similarly, when the angle of the arm 30 with respect to the bracket 42 becomes oriented consistent with the door being opened, a door opened cam 92, also mounted on tubular portion 48, has a protrusion 94 which engages a third limit switch 96 to signal the control means 70 to reverse the direction of the motor. The limit switches 90, 96 both of which are mounted on the bracket 42, and therefore, perform as the door closed detector and the door open detector respectively.

It should be appreciated that the cams 86 and 92 have non-circular bodies with a central opening which fits snuggly around the tubular portion 48 of the drive member 47 so as to not twist when the protrusions thereof engage the limit switches 90, 96 respectively, yet are not so snug that they cannot be turned manually. The door closed and door open detectors can then be adjusted by rotating cams 86, 92 respectively about the cylindrical portion 48.

Figure 9:
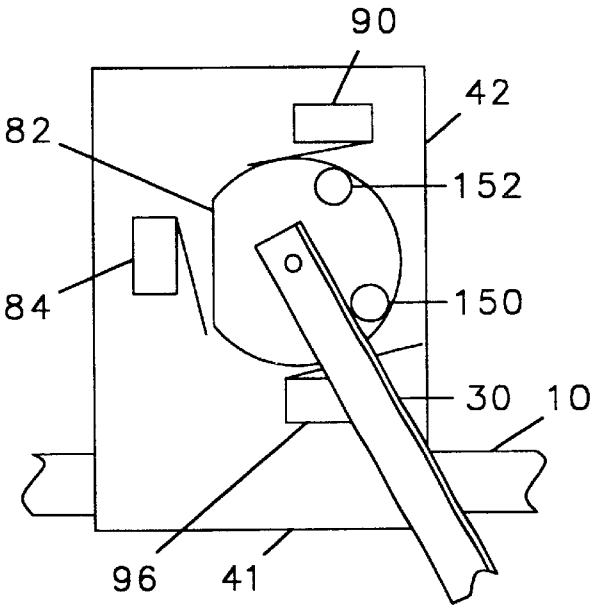
FIG. 9 is a top view of a second embodiment of a drive member for use with the door opening device shown in FIG. 1.

Referring to FIG. 9, the drive pin 50 may be configured as two spaced pins 150, 152 mounted on the annular flange 50 as shown. In this embodiment pin 150 has a surface which pushes the arm 30 when the motor 40 is operated in one direction and the pin 152 has a surface which pushes the arm 30 when the motor is operated in the opposite direction.

While the present invention has been described with respect to a single embodiment, it will be appreciated that many modifications and variations may be made without departing from the true spirit and scope of the invention. Therefore, it is the purpose of the appended claims to cover all such modifications and variations which fall within the true spirit and scope of the invention.

What is claimed is:

1. A door operating device for opening and closing a door in a wall, said device comprising a linkage having first means for connecting to said door, second means for connecting to said wall, and having a moveable member, said member moveable through a path of travel having a first position on said path corresponding to said door in a closed position and a second position on said path corresponding to said door in an open position wherein movement of said member from said first position to said second position corresponds with movement of said door from said closed position to said open position, third means moveable through said path of travel of said member for pushing said member from said first position to said second position, a motor connected to said third means for moving said third means from said first position to said second position, and said third means making abutting contact with said member without being locked for simultaneous movement therewith wherein said member is pushed along said path by said third means for powered opening of said door and said member is moveable free from said third means during a manual opening of said door.

2. A door operating device in accordance with claim 1 and further comprising an axis, and wherein said path of travel is rotational, said member rotating about said axis through an arc in one direction during the opening of said door and rotating about said axis through said arc in an opposite direction during the closing of said door.

3. A door operating device in accordance with claim 1 and further comprising means for returning said third means from said second position to said first position after said third means has pushed said member to said second position.

4. A door operating device in accordance with claim 1 wherein said third means is moveable to a stand-by position outside of said path of travel of said member.

5. A door operating device in accordance with claim 2 wherein said motor is reversible and said device further comprising fourth means connected to said motor for pushing said member from said second position to said first position without said fourth means being locked to said member for simultaneous movement therewith.

6. A door operating device in accordance with claim 5 and further comprising door open detector means for detecting when said door has moved to an open condition, door closed detector means for detecting when said door has moved to a closed condition, start means for receiving an instruction to start said device, and control means connected to said motor and responsive to said door open detector means, said door closed detector means, and said start means, for directing power to said motor upon actuation of said start means and for reversing said motor upon receipt of a signal from one of said door open detector means and said door closed detector means.

7. A door operating device in accordance with claim 6 and further comprising means for detecting when said drive means is in said stand-by position, said control means terminating power to said motor when said drive means has been returned to said stand-by position.

8. A door operating device in accordance with claim 6 and further comprising obstruction limitation means for detecting when such door has encountered an obstruction while said device is operating, and said control means responsive to a signal from said obstruction limitation means where said control means will reverse the direction of said motor on receipt of a signal from said obstruction limitation means.

9. A door operating device for opening and closing a door in an opening in a wall, said device comprising a linkage having a first means for connecting to said door and a second means for connecting to said wall, said linkage including an arm rotatable about a shaft, said arm rotatable in a first direction through an arc extending from a first angular orientation corresponding to said door being opened to a second angular orientation corresponding to said door being closed wherein rotation of said arm from said first orientation to said second orientation corresponds to movement of said door from a closed position to an opened position, said arc being less than 360 degrees, a motor connected to said shaft, third means mounted for rotation with said shaft for contacting said arm without being locked for simultaneous movement therewith wherein rotation of said third means through said arc in said first direction will urge said arm from said first position to said second position thereby opening said door, said third means having a standby angular orientation wherein said third means will not interfere with a manual opening or closing of said door.

10. A door operating device in accordance with claims 9 wherein said motor is reversible for rotating said third means in said first direction for urging said arm from said first angular orientation to said second angular orientation for opening said door and for rotating said third means in a second direction for urging said arm from said second angular orientation to said first angular orientation for closing said door.

11. A door operating device in accordance with claim 10 and further comprising fourth means for returning said third means to said stand-by orientation.

12. A door operating device in accordance with claim 11 and further comprising door open detector means for detecting when said door has moved to an open position, door closed detector means for detecting when said door has moved to a closed position, start means for receiving an instruction to start said devices, and control means connected to said motor and responsive to said door open detector means, said door closed detector means, and said start means, for directing power to said motor upon actuation of said start means and for reversing said motor upon receipt of a signal from one of said door open detector means and said door closed detector means.

13. A door operating device in accordance with claim 12 and further comprising means for detecting when said drive means is in said stand-by position, and said control means terminating power to said motor when said drive means has been returned to said stand-by position in response to a signal from said means for detecting.

14. A door operating device in accordance with claim 12 and further comprising obstruction limitation means for detecting when such door has encountered an obstruction while said device is operating, and said control means responsive to a signal from said obstruction limitation means wherein said control means will reverse the direction of said motor on receipt of a signal from said obstruction limiting means.

* * * * *

UNITED STATES PATENT AND TRADEMARK OFFICE

CERTIFICATE OF CORRECTION

PATENT NO. : 6,430,871 B1
DATED : August 13, 2002
INVENTOR(S) : Thomas J. Hebda

It is certified that error appears in the above-identified patent and that said Letters Patent is hereby corrected as shown below:

Column 4,
Line 67, after “pin 50” delete “reaches” and substitute -- reach --.

Column 5,
Line 1, beginning of the line delete “to”.

Column 6,
Line 33, after “With claim” delete “2” and substitute -- 4 --.

Signed and Sealed this

Tenth Day of December, 2002

JAMES E. ROGAN
*Director of the United States Patent and Trademark Office*